United States Patent [19]

Herrington, Jr. et al.

[11] Patent Number: 5,067,208

[45] Date of Patent: Nov. 26, 1991

[54] PLASTIC RECLOSABLE FASTENER WITH SELF-LOCKING SLIDER

[75] Inventors: F. John Herrington, Jr., Holcomb; Eric A. St. Phillips, Fairport, both of N.Y.

[73] Assignee: Mobil Oil Corporation, Fairfax, Va.

[21] Appl. No.: 673,707

[22] Filed: Mar. 22, 1991

[51] Int. Cl.[5] ..... A44B 19/16

[52] U.S. Cl. ..... 24/400; 24/399; 24/587

[58] Field of Search ..... 24/400, 399, 576, 587; 383/63, 65; 156/66

[56] References Cited

U.S. PATENT DOCUMENTS

| | | | |
|---|---|---|---|
| 2,869,207 | 1/1959 | Bernstein | 24/400 |
| 3,103,049 | 9/1963 | Hawley | 24/400 |
| 3,122,807 | 3/1964 | Ausnit | 24/399 |
| 3,220,076 | 11/1965 | Ausnit et al. . | |
| 3,259,951 | 7/1966 | Zimmerman . | |
| 3,347,298 | 10/1967 | Ausnit et al. | 150/3 |
| 3,426,396 | 2/1969 | Laguerre . | |
| 3,462,332 | 8/1969 | Goto | 156/244 |
| 3,579,747 | 5/1971 | Hawley | 24/400 |
| 3,660,875 | 5/1972 | Gutman . | |
| 3,713,923 | 1/1973 | Laguerre | 156/66 |
| 3,790,992 | 2/1974 | Herz . | |
| 3,806,998 | 4/1974 | Laguerre . | |
| 4,262,395 | 4/1981 | Kosky . | |
| 4,517,710 | 5/1985 | Beckmann | 24/297 |
| 4,736,451 | 4/1988 | Ausnit . | |
| 5,007,142 | 4/1991 | Herrington | 24/400 |
| 5,007,143 | 4/1991 | Herrington | 24/400 |
| 5,010,627 | 4/1991 | Herrington et al. | 24/400 |

FOREIGN PATENT DOCUMENTS

| | | |
|---|---|---|
| 1109532 | 1/1956 | France . |
| 375235 | 1/1940 | Italy . |
| 914203 | 12/1962 | United Kingdom . |
| 914204 | 12/1962 | United Kingdom . |
| 1139838 | 1/1969 | United Kingdom . |

*Primary Examiner*—Victor N. Sakran
*Attorney, Agent, or Firm*—Alexander J. McKillop; Charles J. Speciale

[57] ABSTRACT

A plastic reclosable fastener with slider for opening and closing the reclosable fastener on plastic bags and the like is disclosed. The plastic reclosable fastener and slider include a provision for restraining the slider in closed position and maintaining the male and female elements of the slider in interlocking relation when the slider reaches the closed end of its travel along the tracks of the slider.

6 Claims, 5 Drawing Sheets

FIG. 7
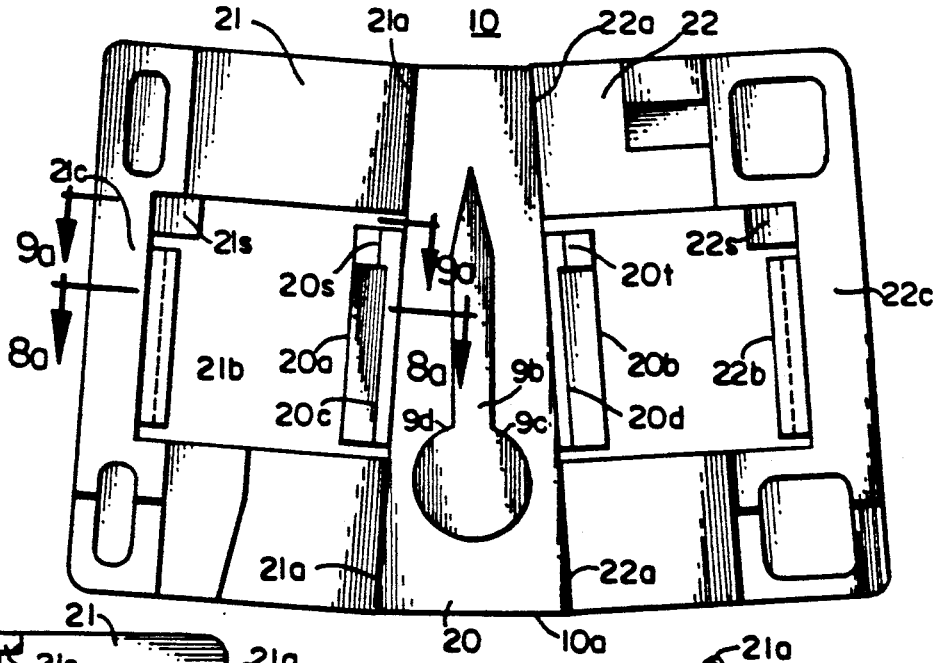
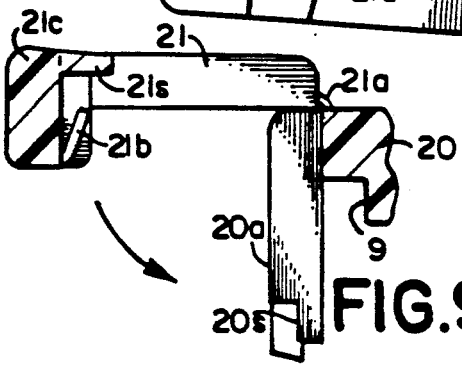
FIG. 9a
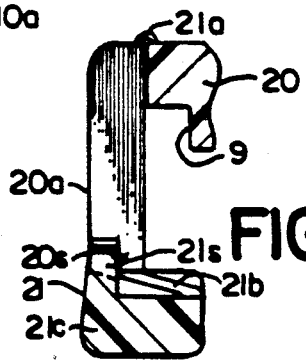
FIG. 9b
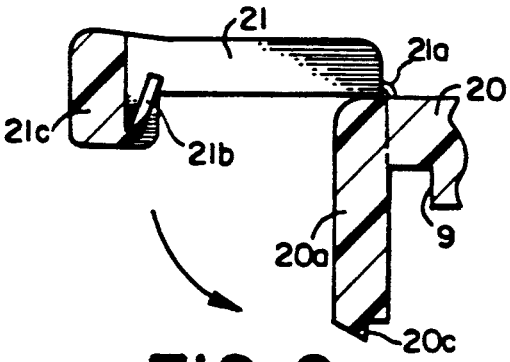
FIG. 8a
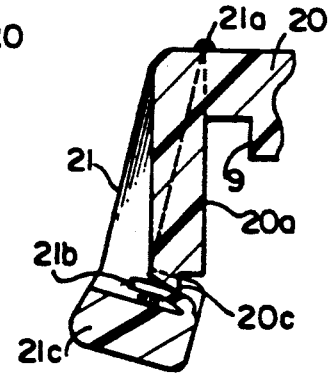
FIG. 8b
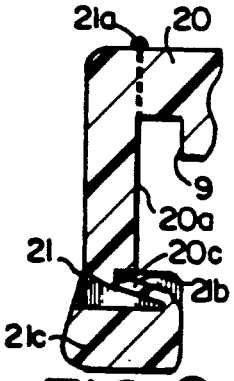
FIG. 8c

PLASTIC RECLOSABLE FASTENER WITH SELF-LOCKING SLIDER

BACKGROUND OF THE INVENTION

The present invention relates to improvements in plastic reclosable fasteners with sliders for opening and closing the reclosable fasteners on plastic bags and the like and particularly to a plastic reclosable fastener with self-locking slider.

Plastic zippers with sliders are well known in the art. The plastic zippers have profiles and include a pair of male and female fastener elements in the form of reclosable interlocking rib and groove elements with a slider for opening and closing the rib and groove elements. In the manufacture of thermoplastic film bags, a pair of these male and female fastener elements extend along the mouth of the bags and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332. The U.S. Pat. No. 3,259,951 discloses an example of a thermoplastic bag where the fastener elements are extruded separately and thereafter attached to the walls along the mouth of the bag. This patent also discloses a slider and flexible closure strips adapted to be joined by such slider to form an air tight closure.

The sliders for opening or closing the reclosable fasteners are adapted to be assembled with the fastener or zipper by an endwise assembly or by a relative transverse maneuver An example of a fastener with an endwise assembly of the slider is disclosed in the aforesaid U.S. Pat. No. 3,259,951. In some instances the sliders are formed of multiple parts and assembled on the zipper. The assembly may be simplified if the slider is formed of one part and the sides are foldable into position when assembled on the zipper. Examples of foldable plastic sliders are disclosed in the related applications referred to below.

RELATED APPLICATIONS

Foldable plastic sliders are disclosed in the related application of F. J. Herrington and Eric A. St. Phillips entitled "Foldable Zipper Slider with Compression-Type Latch" Ser. No. 673,711, filed 03,22,1991, the related application of F. J. Herrington entitled "Gull Wing Zipper Slider" Ser. No. 490,106 filed Mar. 7, 1990 and in the related application of F. J. Herrington and A. Goncarovs entitled "Foldable Plastic Slider and Method of Assembly with a Plastic Reclosable Fastener" Ser. No. 409,108 filed Mar. 7, 1990, now U.S. Pat. No. 5,010,627 and incorporated herein by reference thereto. Another plastic zipper and slider is disclosed in the related application of F. J. Herrington entitled "Rolling Action Zipper Profile and Slider Therefor" Ser. No. 490,110 filed Mar. 7, 1990, now U.S. Pat. No. 5,007,143 and incorporated herein by reference thereto. End termination clips for plastic zippers are disclosed in the related application of F. J. Herrington and Eric A. St. Phillips entitled "End Clamp Stops for Plastic Reclosable Fastener" Ser. No. 673,712 filed 03,22,1991 incorporated herein by reference thereto. Latching structure for a slider is disclosed in the related application of F. J. Herrington and Eric A. St. Phillips entitled "Plastic Reclosable Fastener With Structure for Retaining Slider in Closed Position", Ser. No. 674,648 filed 03,22,1991, incorporated herein by reference thereto. All of the above identified related applications are assigned to the same assignee as the present application.

SUMMARY OF THE INVENTION

It is an object of the present invention to provide a plastic reclosable fastener with self-locking slider particularly suited for plastic bags and the like for closing or opening the reclosable fastener.

It is a further object of the invention to provide a leakproof plastic reclosable fastener with a self-locking slider particularly suited for plastic bags and the like.

It is a further object of the invention to provide a leakproof plastic reclosable fastener with a self-locking foldable slider particularly suited for plastic bags or the like.

The present invention relates to a plastic reclosable fastener with self-locking slider particularly suited for plastic bags and the like for closing or opening the reclosable fastener. The reclosable fastener comprises a pair of flexible plastic strips having separable fastener means extending along the length thereof comprising reclosable interlocking male and female profile elements on the respective strips. The strips include profiled tracks extending along the length thereof parallel to the male and female elements The slider is provided with a separator finger and interlocking complementary structure formed from plastic for moving along the fastener in straddling relation. The complementary structure comprises a transverse support member having the separator finger depending therefrom. The support member is positioned on the top edges of the tracks with the separator finger inserted therebetween. A pair of side walls are positioned on the opposite sides of the support member for receiving the pair of strips therebetween, the separator finger and the side walls extend from an opening end of the slider to a closing end. The separator finger is wider at the opening end of the slider than at the closing end of the slider and the side walls are spaced wider apart at the opening end to permit separation of the male and female elements by the wider end of the separator finger extending between the side walls at the opening end. The side walls are spaced sufficiently close together at the closing end to press the male and female elements into interlocking relationship as the slider is moved in a fastener closing direction. There is further provided means for restraining the slider in closed position and maintaining the male and female elements in interlocking relation when the slider reaches the closed end of its travel along its tracks comprising a protrusion on the wider end of the separator finger adjacent the opening end of the slider and notch structure at the adjacent end of the tracks. The notch structure has an end located on the tracks to permit the wider end of the separator finger to move beyond the end from between the tracks and into the notch structure. The protrusion is engageable with the end of the notch structure when the slider is at the closed end of its travel on the tracks thereby restraining the wider end of the separator finger from moving out of the notch structure and between the tracks and inadvertently opening the male and female elements of the fastener.

In accordance with a further aspect of the invention the protrusion on the wider end of the separator finger is positioned adjacent a narrower end of the separator finger, the narrower end of the separator finger having a transverse dimension which permits it to be received between the tracks without opening the male and female elements of the fastener.

In accordance with a further aspect of the invention the wider end of the separator finger comprises a circular portion, the narrower end of the separator finger comprises a straight sided portion intersecting the circular portion and the protrusion comprises spaced surfaces on the cylindrical portion adjacent the intersecting straight sided portion of the narrower end of the finger.

In accordance with a further aspect of the invention the slider is foldable and the complementary structure additionally comprises a pair of legs depending from the support member on opposite sides of the support member and on opposite sides of the finger. The pair of side walls are hinged to the opposite sides of the support member on opposite sides of the respective legs. The side walls are foldable relative to the separator finger and have openings therein for receiving the depending legs. Means is provided for interlocking the side walls to the depending legs comprising shoulder structure extending along an edge of each of the depending legs and flexible tongue structure extending along a corresponding edge in each of the side walls. A flexible tongue structure is depressible by the edge of the depending legs and adapted to snap into engagement with the respective shoulders on the legs to provide a compression-type latch for locking the side walls in their folded position. The depending legs and foldable side walls include cooperating stop structure engageable with each other when the side walls are in their folded position.

BRIEF DESCRIPTION OF THE DRAWINGS

FIG. 7 is a bottom plan view of the slider of FIG. 2 shown in open position.

FIG. 8*a* is a sectional view taken along the lines 8*a*—8*a* in FIG. 7.

FIG. 8*b* is a sectional view similar to FIG. 8*a* with the foldable wing rotated downwardly into a partially assembled position.

FIG. 8*c* is a sectional view similar to FIGS. 8*a* and 8*b* with the foldable wing fully rotated to the assembled position with the compression-type latch snapped closed.

FIG. 9*a* is a sectional view taken along the lines 9*a*—9*a* in FIG. 7.

FIG. 9*b* is a sectional view similar to FIGS. 9*a* and 9*e*.

PREFERRED EMBODIMENT OF THE INVENTION

Figure 1:
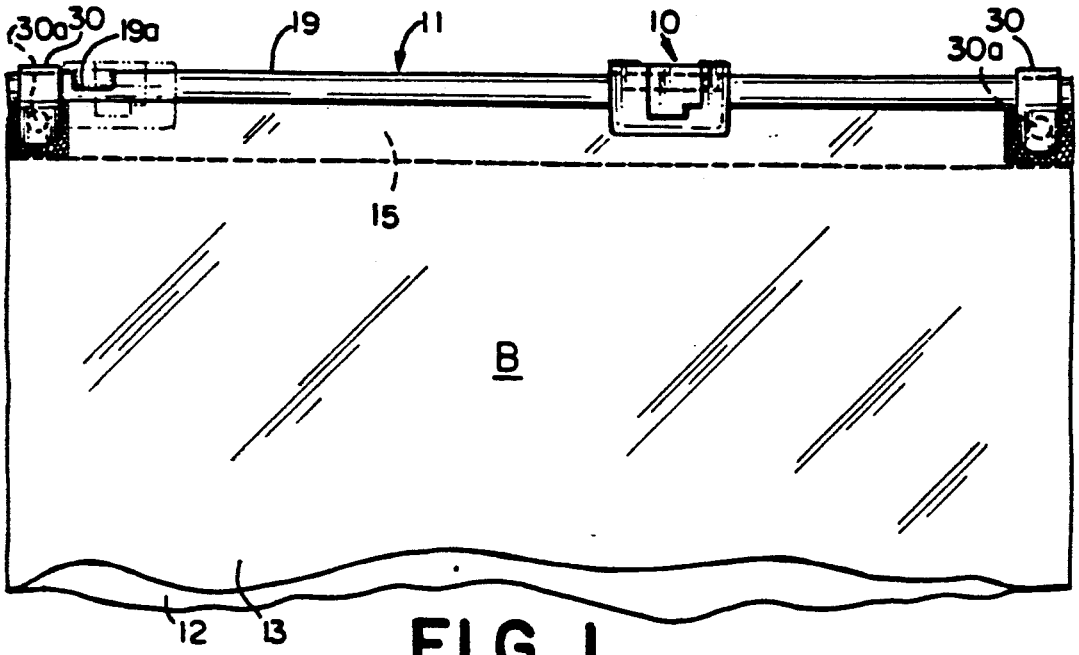
FIG. 1 is a side elevation view of a plastic reclosable fastener with self-locking slider embodying the present invention and mounted on a thermoplastic bag.

Referring to FIG. 1, there is illustrated a plastic slider 10 and a profiled plastic reclosable fastener or zipper 11 10 embodying the present invention. The slider 10 and zipper 11 are particularly suited for thermoplastic bags and the like and the slider 10 has been illustrated in FIGS. 1, 2 and 11 assembled on the zipper 11 at the top edge or mouth of a thermoplastic bag B. The bag B may be made from any suitable thermoplastic film such for example as polyethylene or polypropylene or equivalent material. The bag B is formed by a pair of flexible plastic sheets 12 and 13 joined at the bottom and having a top edge, with a pair of flexible plastic strips 14 and 15 having separable plastic means extending along the length thereof comprising reclosable interlocking male and female profile elements in the form of rib and groove elements 16 and 17 on the respective strips to form the zipper 11. The strips 14 and 15 may be extruded separately and attached to the respective sides of the bag mouth or the strips 14 and 15 may be extruded integral with the sides of the bag mouth. The strips 14 and 15 include profiled tracks 18 and 19 extending along the length thereof parallel to the rib and groove elements 16 and 17 and the rib and groove elements, 16, 17 have complementary cross-sectional shapes such that they are closed by pressing the bottom of the elements together first and then rolling the elements to a closed position toward the top thereof, FIGS. 3–6. The cross-sectional shapes of the interlocking male and female elements having the rib and groove profiles 16 and 17 are the subject of the invention claimed in the aforesaid related application entitled "Rolling Action Zipper Profile and Slider Therefor" Ser. No. 490,110.

As may be seen in FIGS. 1, 2, 10 and 11 the slider 10 straddles the zipper 11 at the top of the bag B and is adapted for opening or closing the reclosable fastener elements 16 and 17 of the zipper 11. The slider 10 is formed from a single piece of molded plastic comprising separator finger 9 and interlocking complementary structure moving along the zipper 11. The separator finger 9 is of novel construction and cooperates with the zipper 11 in such a manner as to provide a self-locking feature for the slider and a leakproof bag as hereinafter to be described in more detail. The slider 10 may be molded from any suitable plastic such for example as nylon, polypropylene, polystyrene, Delrin or ABS.

In the preferred embodiment the complementary structure comprises an inverted U-shaped member including a transverse support member or body 20 from which the separator finger 9 depends. The body 20 is itself U-shaped and includes two integral depending legs 20*a*, 20*b*. The finger 9 is positioned between the legs 20*a*, 20*b*. The body 20 is adapted to move along the top edges of the tracks 18 and 19 with the legs 20*a*, 20*b* straddling these elements and the finger 9 positioned between the tracks 18 and 19. The body 20 also includes a pair of hinged "wings" or side walls 21 and 22 that can be folded down into their final position. The wings 21 and 22 are hinged to the main slider body 20 by means of hinge structure 21*a* and 22*a* located at the opposite ends of the legs 20*a* and 20*b*. It will be noted that the wings 21 and 22 have central openings into which the legs 20*a*, 20*b* extend when the wings 21 and 22 are folded down into their final position as hereinafter to be described. It will be noted that the hinge structure 21*a* and 22*a* is located on the opposite side of the main slider body 20 at the top thereof. When the wings 21 and 22 are folded down from the position in FIG. 9 to the position in FIG. 10 the wings 21 and 22 engage the opposite edges of the body 20. The hinge structure 21*a* and 22*a* is a relatively thin section of the plastic material as compared to the wall thicknesses of the wings 21 and 22 and the flexibility of the plastic material makes possible the use of the integral hinge structure 21*a* and 22*a* which is sometimes referred to as a "living" hinge.

Figure 10:
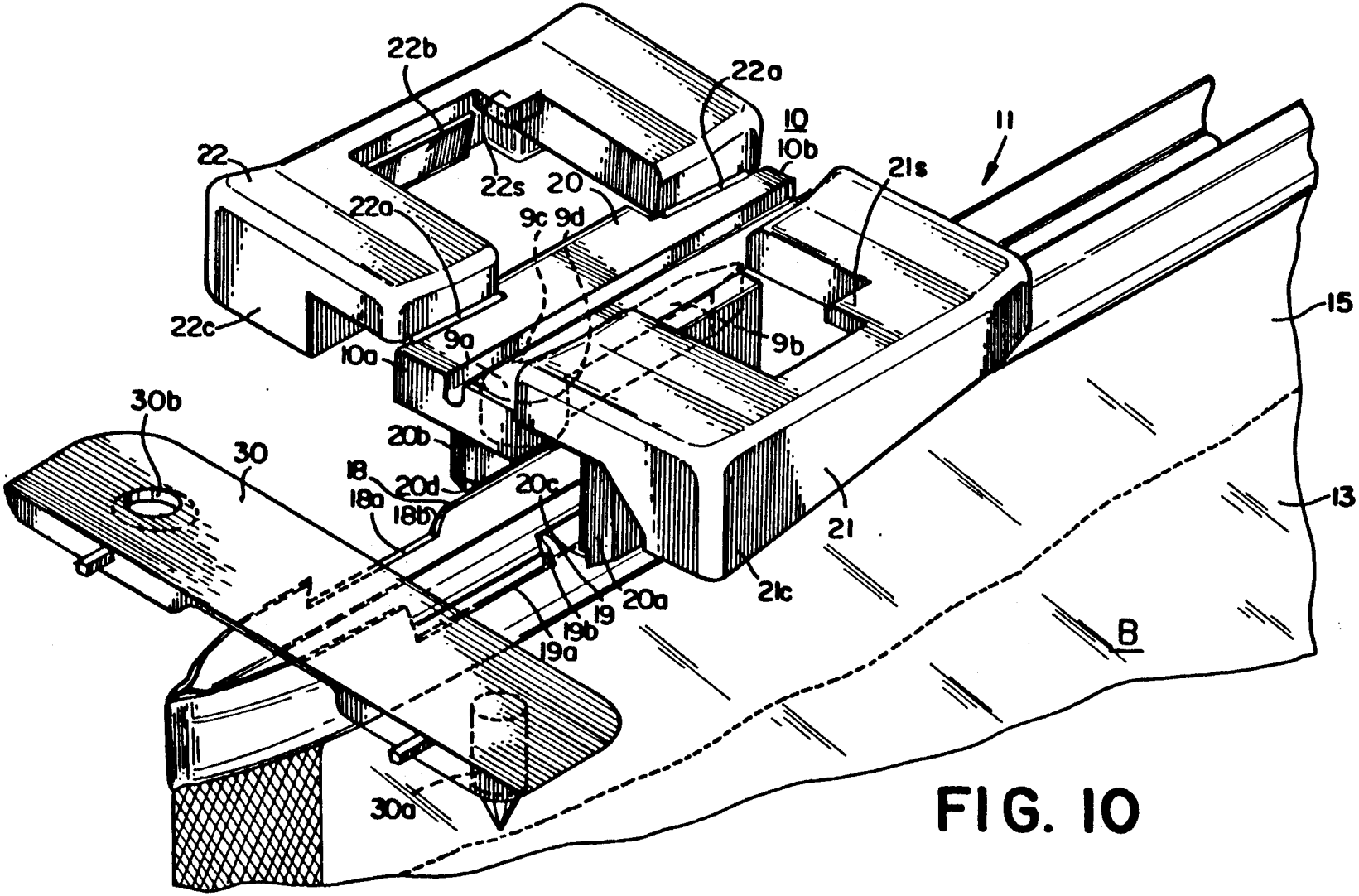
FIG. 10 is a perspective view of the plastic reclosable fastener with self-locking slider embodying the present invention shown in open position preparatory to assembly.

When the wings 21 and 22 are folded down to their final side wall position from the wing position shown in FIG. 9, to the side walls position shown in FIG. 10, the side walls 21 and 22 are held in fixed position by a compression-type slider latch. As may be seen in FIGS. 7 and 8*a*–8*c* the wing 21 is provided adjacent its outer end with a flexible tongue 21*b*. The lower end of the leg 20*a* is provided with an angled surface adjacent a latching shoulder 20*c*. When the wing 21 is rotated in a counter clockwise direction as illustrated by the arrow in FIG. 8*a* the flexible tongue 21*b* will be deflected downward by the angled surface on the lower end of the leg 20*a* as illustrated in FIG. 8*b* and when the wing 21 is in the vertical position as shown in FIG. 8*c* the flexible tongue 21*b* will have snapped in place and moved into engagement with the shoulder 20*c* at the lower end of leg 20*a*. When the wing 21 has moved from the position in FIG. 8*a* to the position shown in FIG. 8*c*, the compression-type latch comprising the tongue 21*b* and the shoulder 20*c* will be in locked position. It will be also noted that the wing 21 is provided with a stop member 21*s*, FIGS. 7, 9*a* and 9*b*, which is adapted to engage a cooperating stop member 20*s* adjacent the lower end of leg 20*a*. When the wing 21 has moved from the position in FIG. 9*a* to the position shown in FIG. 9*b* the stop 21*s* will be in engagement with the stop 20*s* thereby preventing the wing 21 from being moved beyond its latched position thus preventing its over travel from interfering with the latching of opposing wing 22. Once the latch has been engaged it cannot be disengaged without breaking it. As it is being latched the tongue 21*b* deflects downward as shown. However, when attempting to disengage it, the direction in which the force acts on it exerts a component to force it more strongly into engagement. It is to be understood that the other wing 22 likewise has a flexible tongue 22*b* which is adapted to engage a shoulder 20*d*, FIG. 7, at the lower end of the leg 20*b* so as to provide a compression-type latch and lock the wing 22 in place. It is to be further understood that the wing 22 likewise has a stop 22*s* which is adapted to engage a cooperating stop 20*t*, FIG. 7, at the lower end of the leg 20*b* to prevent the wing 22 from being folded beyond its latched position.

Figure 11:
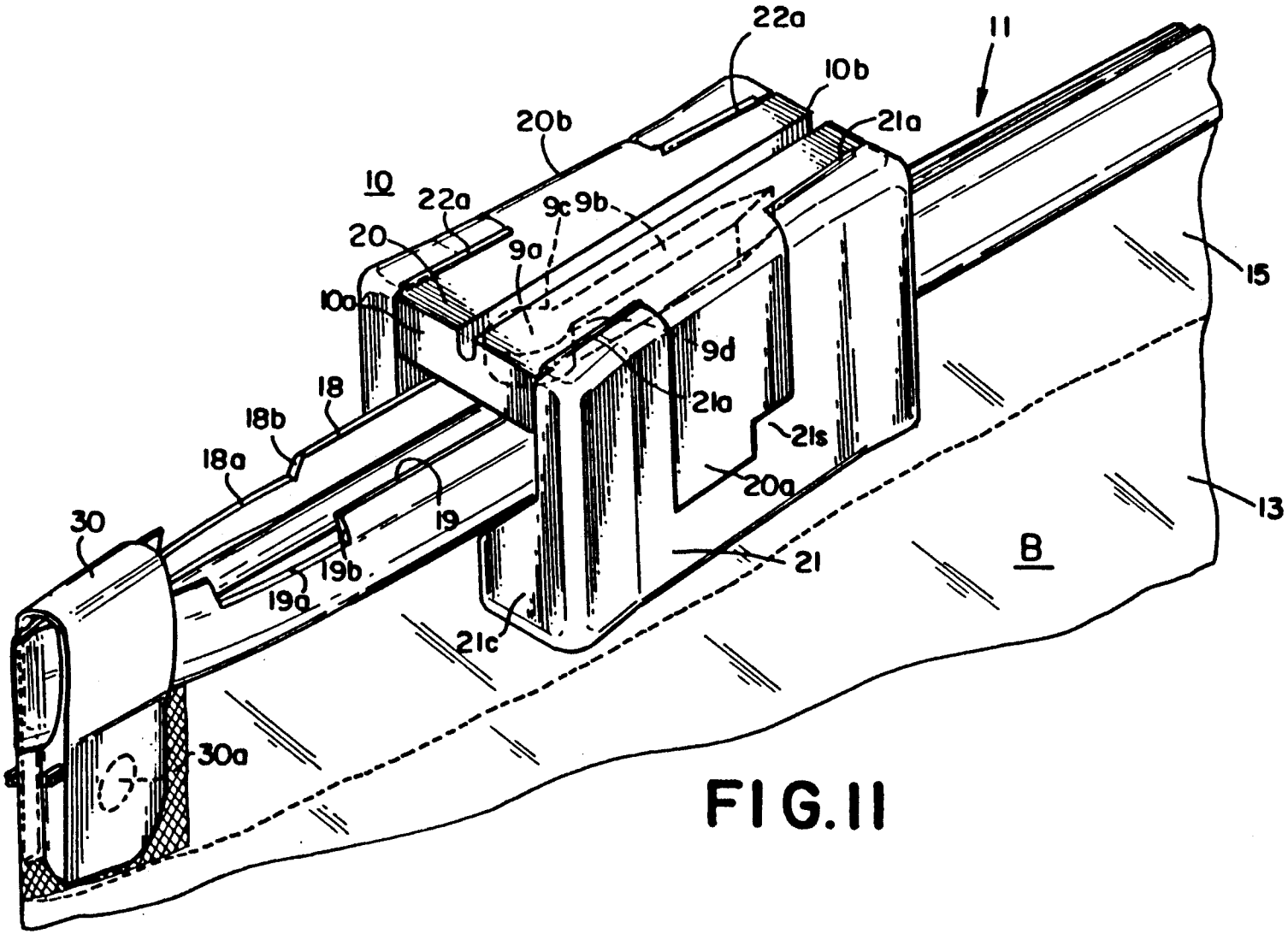
FIG. 11 is a perspective view of the reclosable fastener and self-locking slider in assembled position on a thermoplastic bag.

Thus it will be seen that when the flexible wings 21 and 22 have been moved from the open position shown in FIG. 10 to the lower or locked positions shown in FIG. 11, the wings will be in their downward position with the compression-type latching structure snapped in place, capturing the zipper 11 so that the slider 10 cannot be removed from the zipper 11 after the wings are snapped in place. It will be noted that the latch structure comprising the flexible tongues 21*b*, 22*b* and their cooperating shoulders 20*c* and 20*d* are particularly effective in locking the foldable wings 21 and 22 in the downward position. This is due to the fact that the tongues 21*b* and 22*b* are a relatively long distance from their respective pivots 21*a* and 22*a*. With this arrangement, the latch acts at a maximum distance from the hinge giving the best mechanical advantage. It will also be noted that with this latching arrangement there is still retained the benefit of being able to mold this slider 10 in a simple two-piece mold and thus reduce the cost of manufacture of the slider.

Figure 2:
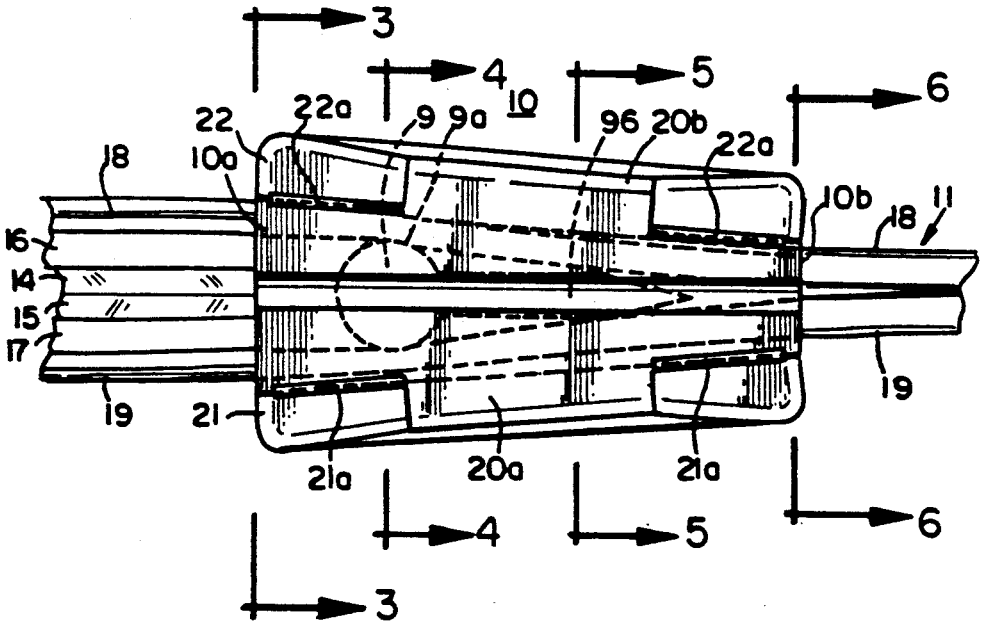
FIG. 2 is a top plan view on enlarged scale of the slider shown in FIG. 1.

As may be seen in FIGS. 2–6 the foldable depending side walls 21 and 22 extend from an opening end 10*a* of the slider 10 to a closing end 10*b*. It will also be noted that the main slider body 20 and the separator finger 9 are wider at the opening end 10*a* then at the closing end 10*b*. Similarly the side walls 21 and 22 and the depending legs 20*a* and 20*b* are spaced wider apart at the opening end 10*a* of the slider 10, FIGS. 2 and 3, to permit separation of the rib and groove elements 16 and 17 by the finger 9 engaging the tracks 18 and 19 and are spaced sufficiently close together at the closing end 10*b* of the slider, FIG. 6, to press the rib and groove elements 16 and 17 into interlocking relationship as the slider 10 is moved in a fastener closing direction. The side walls 21 and 22 at their lower ends are provided with inwardly extending shoulder structure 21*c* and 22*c*, FIGS. 3–6, for engaging the bottom of the fastener comprising the rib and groove elements 16 and 17 to prevent slider 10 from being lifted off the to edges of the tracks 18, 19 on the zipper 11 while the slider straddles the zipper as shown in FIGS. 2 and 11.

Figure 3:
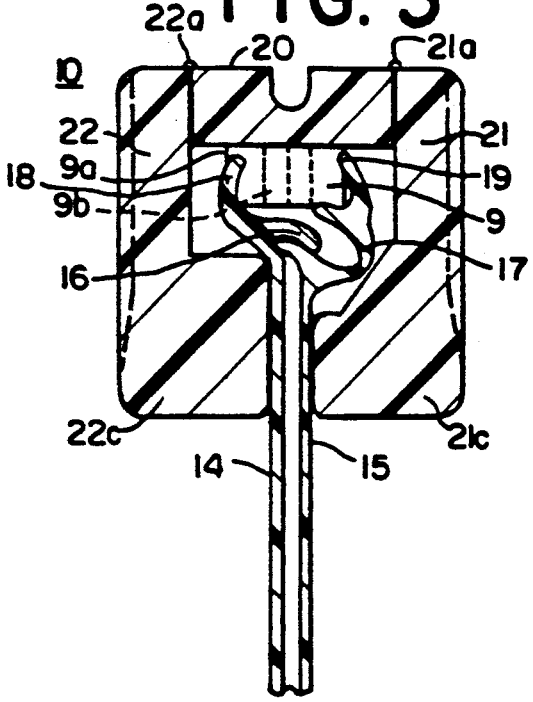
FIG. 3 is a sectional view taken along the lines 3—3 in FIG. 2.
Figure 4:
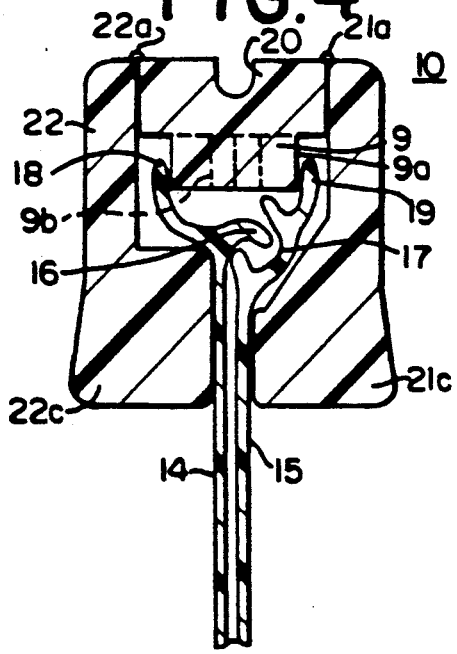
FIG. 4 is a sectional view taken along the lines 4—4 in FIG. 2.

The depending plastic separator finger 9 which extends between the side walls 21 and 22 and the depending legs 20*a* and 20*b* is wider adjacent the opening end 10*a* of the slider 10 for separating the rib and groove elements 16 and 17 of the zipper 11 as the slider 10 is moved in the fastener opening direction, FIGS. 2–4. As may best be seen in FIG. 7 the wider end of the separator finger 9 includes a circular portion 9*a*. The separator finger also includes a narrower end comprising a straight sided portion 9*b* intersecting with the circular portion 9*a*. The wider end of the separator finger 9 includes a protrusion which is formed by spaced surfaces or shoulders 9*c* and 9*d* on the cylindrical portion 9*a* adjacent the intersecting straight sided portion 9*b* at the narrower end of the finger 9. The protrusion structure 9*c*, 9*d* comprises one portion of the means for restraining the slider 10 in closed position and maintaining the male and female elements 16 and 17 in interlocking relation when the slider 10 reaches the closed end of its travel along the tracks 18 and 19. The other portion of the restraining means comprises notch structure 18*a* and 19*a* at the adjacent end of the tracks 18 and 19 respectively. This is best seen in FIGS. 10 and 11.

The notch structure 18*a* and 19*a* each have an end 18*b* and 19*b* located on the respective tracks 18 and 19 to permit the wider end 9*a* of the separator finger 9 to move beyond the notch ends 18*b*, 19*b* from between the tracks 18, 19 and into the notch structure 18*a*, 19*a*. The protrusion surfaces 9*c*, 9*d* are engageable respectively with the ends 18*b*, 19*b* of the notch structure 18*a*, 19*a* when the slider 10 is at the closed end of its travel on the tracks 18, 19. This restrains the wider end 9*a* of the separator finger 9 from moving out of the notch structure 18*a*, 19*a* and between the tracks 18, 19 and inadvertently opening the male and female elements 16 and 17 of the fastener or zipper 11. When the wider portion 9*a* of the separator finger 9 moves into the notch structure 18*a*, 19*a* and out from between the solid portions of the track 18, 19 this permits the solid portions of the track 18, 19 to be squeezed together along with the interlocking rib and groove elements 16 and 17 by the side walls of the slider 10. When the wider portion 9a of the finger 9 is in the notch structure 18a, 19a, the wider portion 9a of the finger 9 is ineffective to force the tracks 18, 19 apart which in turn would cause the rib and groove elements 16 and 17 to be pulled apart thus opening the zipper.

Thus it will be seen that when the slider 10 is at the left hand end of the zipper 11 as shown in phantom in FIG. 1, the zipper 11 will be closed or sealed throughout its length thus providing a leakproof closure for the bag B. The slider 10 will be restrained in this self-locking position by reason of the protrusion 9c, 9d on the wider end of the separator finger 9 engaging the cooperating ends 18b, 19b on the notch structure 18a, 19a of the zipper. When the slider 10 is grasped and pulled to the right to a position as shown in FIGS. 1 or 11, the restraining action provided by the engagement of the surfaces 9c, 9d with the respective notch ends 18b, 19b is overcome thereby causing the wider end 9a of the finger 9 to force apart the solid edges of the tracks 18 and 19 which in turn cause the interlocking rib and groove elements 16 and 17 of the zipper 11 to move apart as the slider 10 is moved from the closed or left hand end of the zipper 11 toward the right hand end. The foregoing restraining action takes effect only when the slider 10 reaches the closed end of its travel at the left hand end of the zipper 11. This gives the user of the bag B the feel of a secure closure and assurance that the bag is closed with certainty. This is an important requirement with leakproof bags.

Referring again to FIG. 1 it will be seen that the opposite ends of the zipper 11 are provided with end termination clips or clamps 30, 30. Each of the end clamps 30 is identical and are best shown in FIGS. 10 and 11. Each end clamp 30 comprises a strap member which wraps over the top of the zipper 11. One end of the strap is provided with a rivet like member 30a which is adapted to penetrate through the bag material and into a cooperating opening 30b at the other end of the clamp 30. The pin 30a is deformed to form a head locked into the opening 30b. The deformation may be done by pressure, heat or ultrasonically. The end clamps 30 perform the dual function of stops for the ends of the zipper 11 to prevent the slider 10 from going off past the end of the zipper 11 and they also hold the two zipper elements together to resist stresses applied to the zipper elements through normal use of the bag. The stops 30 also provide a convenient finger grip for the user when moving the slider 10 in an opening or closing direction. This subject matter is claimed in the aforesaid copending application Ser. No. 673,712.

Figure 5:
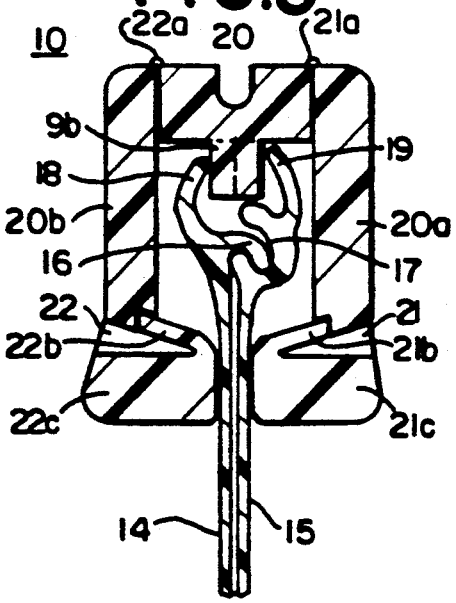
FIG. 5 is a sectional view taken along the lines 5—5 in FIG. 2.
Figure 6:
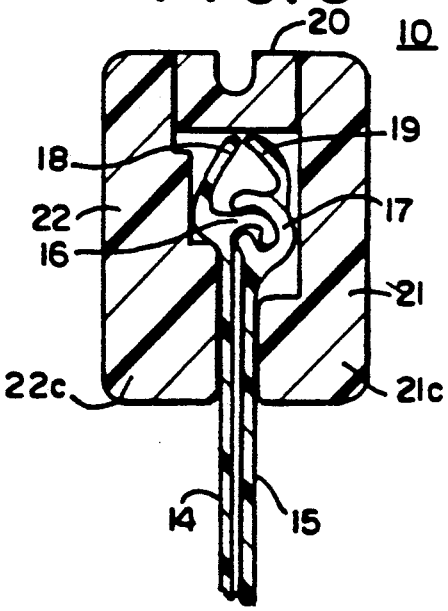
FIG. 6 is a sectional view taken along the lines 6—6 in FIG. 2.

Referring to FIGS. 10 and 11 there is illustrated a method of assembly of the foldable plastic slider 10 with the profiled plastic reclosable fastener 11 of a thermoplastic bag B formed by the pair of flexible plastic sheets 12 and 13 having a top edge, with a pair of the flexible plastic strips 14 and 15 at the top edge extending along the length thereof, having tracks 18 and 19 reclosable interlocking rib and groove profile elements 16 and 17 on the facing surfaces thereof. The interlocking rib and groove profile elements 16 and 17 on the facing surfaces are placed in alignment so that they can be joined as indicated at the right hand end of FIGS. 2 and 10. The foldable slider 10 with the wings 21 and 22 in the open position, FIG. 10, is positioned above the profile elements 16 and 17 as shown in FIG. 1. When the elements 16 and 17 are joined as indicated at the right hand end of FIG. 2, the depending finger 9 is inserted between the top edges of the tracks 18 and 19 as shown in FIG. 3. The depending legs 20a and 20b are positioned on the outer sides of the strips 14 and 15 as shown in FIGS. 2 and 5. The body 20 of the slider 10 then rests on the top of the tracks 18 and 19. The wings 21 and 22 are then folded down as indicated by the arrow in FIG. 8a at the hinged structure 21a and 22a located at the top of the slider body 20 so that the wings 21 and 22 are in their folded side wall position against the edges of the slider body 20 as shown in FIGS. 2 and 11. When the side walls 21 and 22 are moved to the folded position shown in FIG. 11, the compression-type latching mechanism comprising the flexible tongues 21b, 22b will have been compressed and snapped into locked position with the corresponding shoulders 20c, 20d, FIG. 5. The mating stops 21s, 20s, FIGS. 7, 9a, 9b, and 22s and 20, FIG. 7, prevent the wings 21 and 22 from being folded past their latched position. Thus when the compression-type latching mechanism is locked in position as shown in FIG. 5 can't be reopened and the side walls 21 and 22 are prevented from being rotated outwardly around the hinge structure 21a and 22a. In this assembled position the shoulders 21c and 22c on the side walls 21 and 22 are positioned beneath the bottom of the fastener elements 16 and 17, FIGS. 3–6, to prevent the slider 10 from being lifted off the zipper 11.

Since the side walls 21 and 22 of the foldable slider 10 are integral with the body portion 20, this provides for ease in assembly as distinguished from multiple part sliders. It also provides for ease in manufacturing and molding as pointed out above. By providing the compression-type latch structure at a maximum distance from the hinge structure 21a and 22a there is assured a tight locking of the wings 21 and 22 when they are moved to their closed downward position as shown in FIG. 11. This compression-type latch mechanism insures that the foldable wings 21 and 22 will not be accidentally unlatched so that the slider 10 could become detached from the zipper structure 14, 15. Also since the slider is made from plastic material it can be used on a food bag in a microwave whereas a metal slider cannot. While a preferred form of the invention has been described in connection with a living hinge, other plastics which are not suitable for making a living hinge can be used. Thus more brittle plastics can be used. It is only necessary that the side walls be folded down once and latched in place by the compression-type latch since the slider is not removed from the reclosable fastener elements once it is assembled.

To insure that the bags will be leakproof a pre-seal is formed either by heat or ultrasonically on the plastic strips 14 and 15 at the side seal locations to reduce the material thickness and prepare for a leakproof end termination. An end termination clip 30 which straddles the side seal location on the strips 14 and 15 is folded around the zipper 11 and sealed in place in the manner previously described. The end clips 30 reinforce the zipper termination at the respective ends of the bag. The tracks 18 and 19 are notched at 18a and 19a providing a leak-free parking spot for the separator finger 9 of the slider 10 adjacent the end termination clip 30 on the closed end of the bag.

While a preferred embodiment of the invention have been described and illustrated, it is to be understood that further modifications thereof may be made within the scope of the appended claims without departing from the spirit of the invention.

What is claimed is:

1. A plastic reclosable fastener with self-locking slider particularly suited for plastic bags and the like for closing or opening the reclosable fastener, said reclosable fastener comprising a pair of flexible plastic strips having separable fastener means extending along the length thereof comprising reclosable interlocking male and female profile elements on the respective strips, said strips including profiled tracks extending along the length thereof parallel to said male and female elements, said slider having a separator finger and interlocking complementary structure formed from plastic for moving along the fastener in straddling relation, the complementary structure comprising a transfer support member having said separator finger depending therefrom, said support member being positioned on the top edges of said tracks with said separator finger inserted therebetween, a pair of side walls on the opposite sides of said support member for receiving said pair of strips therebetween, said separator finger and said side walls extending from an opening end of the slider to a closing end, said separator finger being wider at said opening end of said slider than at the closing end of said slider, the side walls being spaced wider apart at the opening end to permit separation of the male and female elements by the wider end of said separator finger extending between the side walls at the opening end, the side walls being spaced sufficiently close together at closing end to press the male and female elements into interlocking relationship as the slider is moved in a fastener closing direction, and means for restraining said slider in closed position and maintaining said male and female elements in interlocking relation when said slider reaches the closed end of its travel along said tracks comprising a protrusion on said wider end of said separator finger adjacent said opening end of said slider and notch structure at the adjacent end of said tracks, said notch structure having an end located on said tracks to permit said wider end of said separator finger to move beyond said end from between said tracks and into said notch structure, said protrusion being engageable with the end of said notch structure when said slider is at the closed end of its travel on said tracks thereby restraining said wider end of said separator finger from moving out of said notch structure and between said tracks and inadvertently opening said male and female elements of said fastener.

2. A plastic reclosable fastener with self-locking slider according to claim 1 wherein said protrusion on said wider end of said separator finger is positioned adjacent a narrower end of said separator finger, said narrower end of said separator finger having a transverse dimension which permits it to be received between said tracks without opening said male and female elements of said fastener.

3. A plastic reclosable fastener with self-locking slider according to claim 2 wherein said wider end of said separator finger comprises a circular portion, said narrower end of said separator finger comprises a straight sided portion intersecting said circular portion and said protrusion comprises spaced surfaces on the cylindrical portion adjacent the intersecting straight sided portion of said narrower end of said finger.

4. A plastic reclosable fastener with self-locking slider according to claim 1 wherein said slider is foldable, said complimentary structure additionally comprises a pair of legs depending from said support member on opposite sides of said support member and on opposite sides of said finger, said pair of side walls are hinged to the opposite sides of said support member on opposite sides of the respective legs, said side walls being foldable relative to said separator finger and having openings therein for receiving said depending legs, and means for interlocking said side walls to said depending legs comprising shoulder structure extending along an edge of each of said depending legs and flexible tongue structure extending along a corresponding edge in each of said side walls, said flexible tongue structure being depressible by the edge of said depending legs and adapted to snap into engagement with the respective shoulders on said legs to provide a compression-type latch for locking said side walls in their folded position.

5. A plastic reclosable fastener with self-locking slider according to claim 4 wherein said shoulder structure extends along the lower end of each of said depending legs, and said flexible tongue structure extends along the lower end of the openings in each of said side walls and is depressible by the lower ends of said depending legs.

6. A plastic reclosable fastener with self-locking slider according to claim 4 wherein said depending legs and foldable side walls include cooperating stop structure engageable with each other when said side walls are in their folded position.

* * * * *